US008714943B2

(12) United States Patent
Bahmata et al.

(10) Patent No.: US 8,714,943 B2
(45) Date of Patent: May 6, 2014

(54) MOUNTING AND DAMPING SYSTEM FOR A COMPRESSOR

(75) Inventors: Aurelian Bahmata, South Lyon, MI (US); Robert C. Trela, Plymouth Township, MI (US)

(73) Assignee: Halla Visteon Climate Control Corporation, Daejeon (KR)

( * ) Notice: Subject to any disclaimer, the term of this patent is extended or adjusted under 35 U.S.C. 154(b) by 747 days.

(21) Appl. No.: 12/893,411

(22) Filed: Sep. 29, 2010

(65) Prior Publication Data

US 2012/0076680 A1 Mar. 29, 2012

(51) Int. Cl.

| | |
|---|---|
| ***F04B 17/00*** | (2006.01) |
| ***F04B 35/00*** | (2006.01) |
| ***F16D 1/08*** | (2006.01) |
| ***F16D 1/00*** | (2006.01) |

(52) U.S. Cl.
USPC ..... 417/363; 417/360; 403/365; 403/408.1

(58) Field of Classification Search
USPC ..... 417/360, 361, 363; 248/635; 403/365, 403/408.1; 267/140.13, 141
See application file for complete search history.

(56) References Cited

U.S. PATENT DOCUMENTS

| | | | | |
|---|---|---|---|---|
| 2,702,681 | A | 2/1955 | Jacoby | |
| 3,675,881 | A | 7/1972 | Caldwell | |
| 3,990,737 | A * | 11/1976 | Palmer | 296/35.1 |
| 4,676,473 | A | 6/1987 | Giles | |
| 4,938,448 | A * | 7/1990 | Shimazaki | 248/635 |
| 4,993,682 | A | 2/1991 | Imai et al. | |
| 4,998,071 | A | 3/1991 | Strid et al. | |
| 5,052,530 | A | 10/1991 | Shimazaki | |
| 5,090,657 | A | 2/1992 | Dreiman | |
| 5,195,717 | A * | 3/1993 | Benz et al. | 248/638 |
| 5,221,192 | A | 6/1993 | Heflin et al. | |
| 5,277,554 | A | 1/1994 | Elson | |
| 5,342,179 | A | 8/1994 | Dreiman | |
| 5,386,962 | A | 2/1995 | Adriance et al. | |
| 5,454,543 | A * | 10/1995 | Carrico | 248/674 |
| 5,470,207 | A * | 11/1995 | Shockey et al. | 417/313 |
| 5,810,322 | A | 9/1998 | Zhao et al. | |
| 5,913,892 | A | 6/1999 | Kwon | |
| 5,953,932 | A | 9/1999 | Kwon | |
| 6,029,942 | A | 2/2000 | Daddis, Jr. et al. | |
| 6,352,247 | B1 | 3/2002 | Ishikawa et al. | |
| 6,460,823 | B1 * | 10/2002 | Herder et al. | 248/637 |
| 6,471,179 | B1 * | 10/2002 | Tousi et al. | 248/635 |
| 6,669,452 | B2 * | 12/2003 | Ogawa et al. | 417/360 |

FOREIGN PATENT DOCUMENTS

| | | |
|---|---|---|
| DE | 10033870 A1 | 6/2001 |
| JP | 10285864 A | 10/1998 |

* cited by examiner

*Primary Examiner* — Bryan Lettman
*Assistant Examiner* — Lilya Pekarskaya
(74) *Attorney, Agent, or Firm* — Fraser Clemens Martin & Miller LLC; J. Douglas Miller

(57) ABSTRACT

A mounting and damping system for a compressor including a mounting lug removably coupled to at least a portion of a housing of the compressor and a damping member disposed therebetween. The mounting lug and the damping member include at least one aperture formed therein to receive a bushing therethrough, wherein an outer diameter of the bushing is substantially smaller than a diameter of the aperture formed in the mounting lug to militate against contact therebetween.

18 Claims, 2 Drawing Sheets

MOUNTING AND DAMPING SYSTEM FOR A COMPRESSOR

FIELD OF THE INVENTION

The present invention relates to a compressor. More particularly, the invention is directed to compressor having an integrated mounting and damping system which minimizes noise and vibration of the compressor.

BACKGROUND OF THE INVENTION

Presently known hybrid vehicles utilize a combination of an electric drive motor and an internal combustion engine to power and propel the vehicle. Typically, the hybrid vehicles use an electric air conditioning compressor including a compression mechanism such as a scroll compression mechanism, for example, driven by an electric motor. An advantage of using the electric air conditioning compressor compared to a belt-driven compressor is the electric compressor can be operated independent of the internal combustion engine. Accordingly, the electric compressor can continue to operate when the internal combustion engine is turned off.

In many cases, hybrid vehicles and non-hybrid vehicles are manufactured from a single platform employing many of the same components. The hybrid vehicles typically use the same internal combustion engine as the non-hybrid vehicles and employ a substantially similar mounting location for the internal combustion engine. Accordingly, a desired mounting location for the electric compressor of the hybrid vehicles is where the belt-driven compressor is mounted in the non-hybrid vehicles. This allows a vehicle manufacturer to utilize the same air conditioning components (e.g. suction lines and discharges lines) in the hybrid vehicles that are used in the non-hybrid vehicles.

Rotating machinery such as air conditioning compressors, however, inherently generate substantial noise and vibration due to sliding and rolling contact of mating internal parts and a compression of a refrigerant disposed therein. The noise and vibration is an issue that continuously needs to be addressed with each vehicle application, and is of greater concern in hybrid vehicles which are quieter than the non-hybrid counterpart. Conventional air conditioning compressors, both belt-driven and electric, are generally mounted to a vehicle engine or body by a plurality of mounting lugs. The mounting lugs are typically cast into and are integral with a housing of the compressor. As a result, the vibration of the compressor is transmitted through the mounting lugs to the vehicle engine or body, creating an undesirable noise inside a vehicle passenger cabin and causing a substantial noise to emanate directly from the compressor.

It would be desirable to develop an integrated mounting and damping system for a compressor, which efficiently and cost effectively minimizes vibration and noise of the compressor, while substantially maintaining an existing package size thereof.

SUMMARY OF THE INVENTION

In concordance and agreement with the present invention, an integrated mounting and damping system for a compressor, which efficiently and cost effectively minimizes vibration and noise of the compressor, while substantially maintaining an existing package size thereof, has surprisingly been discovered.

In one embodiment, the mounting and damping system for a compressor comprises: a mounting lug removably coupled to a housing of the compressor; a first damping member disposed between the mounting lug and at least a portion of the housing; and a bushing having a through opening formed therein, wherein the bushing is disposed in an aperture formed in at least one of the mounting lug, the at least a portion of the housing, and the first damping member.

In another embodiment, the mounting and damping system for a compressor comprises: a mounting lug removably coupled to a flange extending outwardly from a housing of the compressor, wherein the mounting lug and the flange includes at least one aperture formed therein; a first damping member disposed between the mounting lug and the flange of the housing, the first damping member including at least one aperture formed therein; and a second damping member disposed between the flange and a retainer, the second damping member including at least one aperture formed therein, wherein the aperture of the mounting lug, the aperture of the first damping member, and the aperture of the second damping member are substantially aligned.

In another embodiment, the mounting and damping system for a compressor comprises: a mounting lug removably coupled to a flange extending outwardly from a housing of the compressor, wherein the mounting lug and the flange includes at least one aperture formed therein; a first damping member disposed between the mounting lug and the flange of the housing, the first damping member including at least one aperture formed therein; and a second damping member disposed between the flange and a retainer, the second damping member including at least one aperture formed therein, wherein the aperture of the mounting lug, the aperture of the first damping member, and the aperture of the second damping member are substantially aligned.

Advantages of the mounting and damping system according to the invention is that it is a compact means to minimize vibration transmitted from the compressor to the engine and from the engine to the compressor, and to minimize noise generated by the compressor. The mounting and damping system also allows easier packaging and installation of the compressor into the vehicle at any point of manufacturing. It is a simple, tunable design, which is easy to assemble and targets problematic noise frequencies by adjusting a durometer of a resilient elastomeric element at each isolation point.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF THE INVENTION

The following detailed description and appended drawings describe and illustrate an exemplary embodiment of the invention. The description and drawings serve to enable one skilled in the art to make and use the invention, and are not intended to limit the scope of the invention in any manner.

Figure 1:
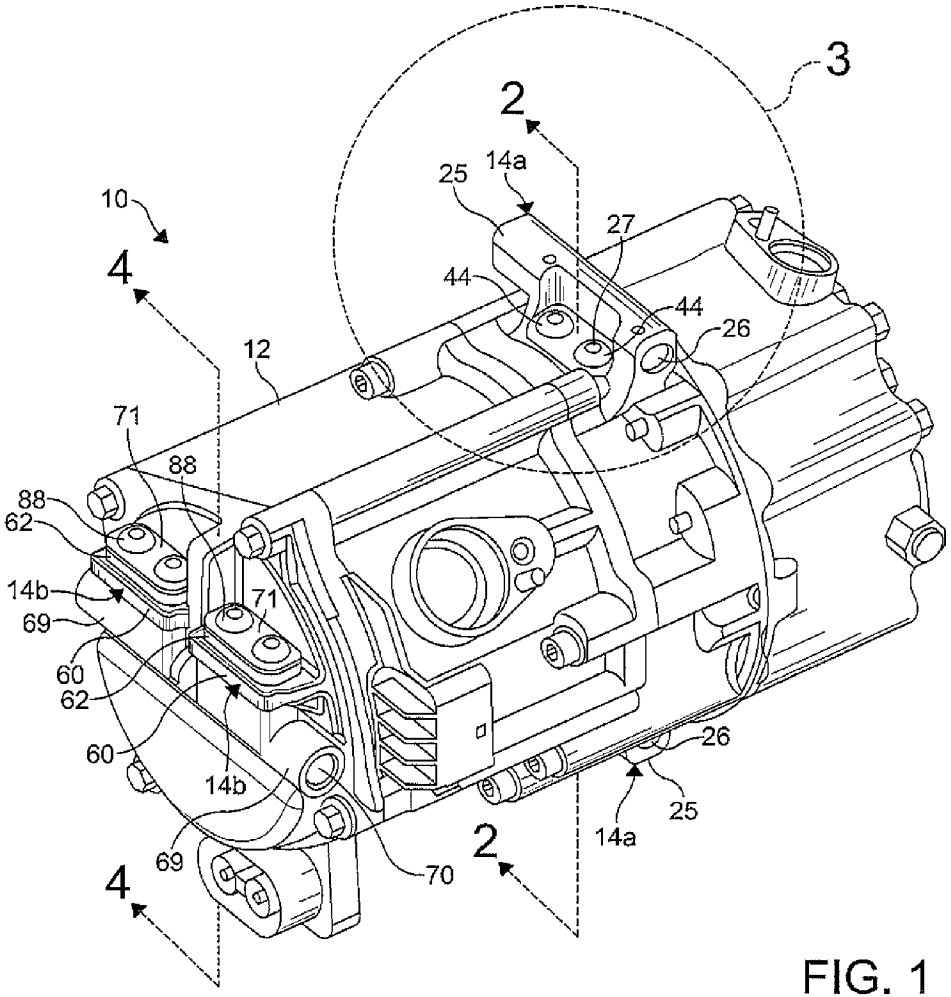
FIG. 1 is a top perspective view of a compressor including an integrated mounting and damping system according to an embodiment of the present invention.

FIG. 1 shows a compressor 10 according to an embodiment of the present invention. The compressor 10 as described herein may be used as an air conditioning compressor for a hybrid vehicle, for example. The compressor 10 includes a housing 12 and at least one compression mechanism (not shown) disposed in a hollow interior of the housing 12. The housing 12 shown has a generally cylindrical shape. It is understood, however, that the housing 12 can have any shape and size as desired. Integrated mounting and damping systems 14*a*, 14*b* are coupled to the housing 12 to minimize noise and vibration transmitted to and from the compressor 10. Additional or fewer of the mounting and damping systems 14*a*, 14*b* than shown can be employed as desired. It is understood that the mounting and damping systems 14*a*, 14*b* can be employed in any device which requires vibration isolation.

Figure 2:
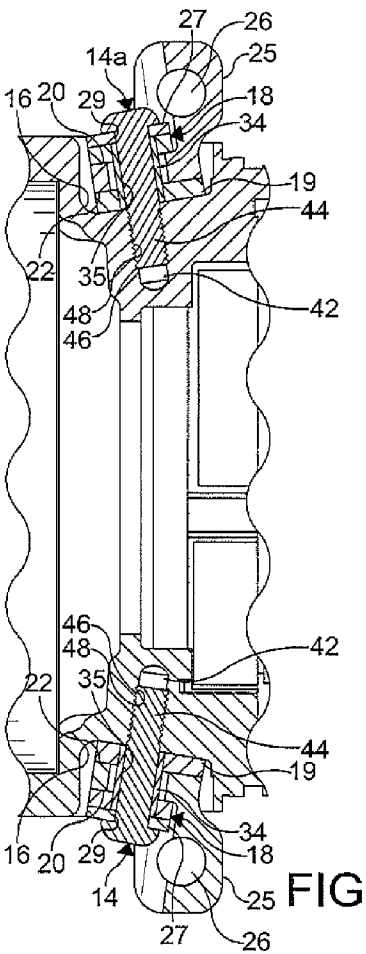
FIG. 2 is an enlarged fragmentary cross-sectional side elevational view of a portion of the compressor illustrated in FIG. 1 taken along line 2-2 of FIG. 1.
Figure 3:
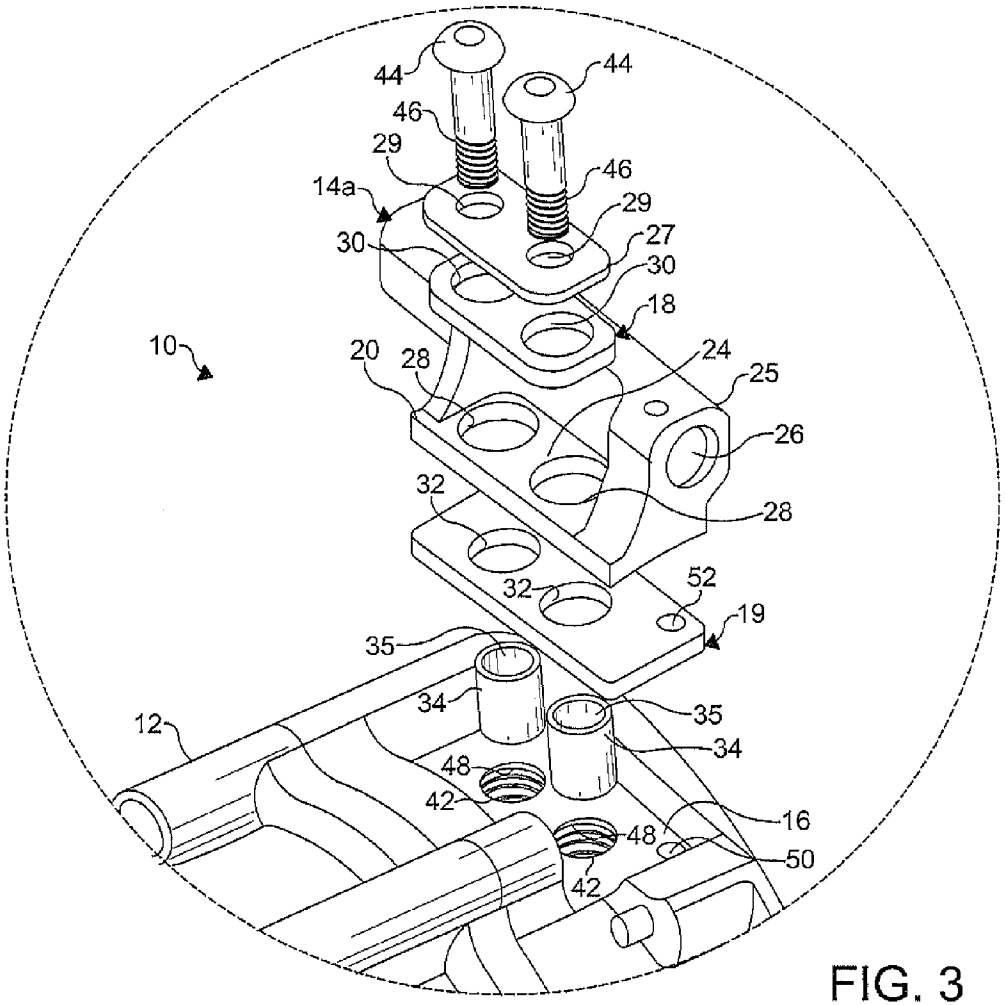
FIG. 3 is an enlarged fragmentary partially exploded top perspective view of a portion of the compressor within the circled area 3 illustrated in FIG. 1.

As illustrated in FIGS. 2-3, each of the mounting and damping systems 14*a* is received in a cavity 16 formed in the housing 12 of the compressor 10. The cavity 16 can be formed in the housing 12 during a casting of the housing 12 or machined in the housing 12 subsequent the casting thereof, if desired. It is understood, however, that each of the mounting and damping systems 14*a* can be flush mounted to the housing 12 of the compressor, if desired. In the embodiment shown, the mounting and damping system 14*a* includes a pair of damping members 18, 19 disposed on opposite sides 20, 22 of a substantially planar portion 24 of a mounting lug 25 to isolate the mounting lug 25 from the housing 12 of the compressor 10. Accordingly, the compressor 10 is also isolated from an engine or bracket (not shown) that the mounting lug 25 is affixed to. As illustrated, the mounting lug 25 includes an elongate aperture 26 formed therein. The aperture 26 receives a fastener (not shown) therein for affixing the mounting lug 25 to the engine or bracket.

Each of the damping members 18, 19 shown can be formed from any suitable material to minimize noise and vibration transmitted to and from the compressor 10 such as a resilient elastomer material (e.g. rubber) or a resilient polymer material (e.g. plastic) having a hardness in a range of about 10 Shore A durometer to about 100 Shore A durometer, for example. It is understood, however, that each of the damping members 18, 19 of each of the mounting and damping systems 14*a* can be formed from a material (e.g. elastomer, polymer) having different chemical and physical properties (e.g. hardness) to optimize and tune an assembled state of the compressor 10. It is further understood that the damping members 18, 19 can be formed by any process as desired such as a molding process or a stamping process, for example.

The mounting and damping system 14*a* may further include a retainer 27. The retainer 27 is employed to maintain a position of the damping member 18 and militate against damage thereto. As shown, the retainer 27 includes a plurality of apertures 29 formed therein. It is understood that the retainer 27 can be formed from any material as desired such as a metal material, for example. Although each of the damping members 18, 19 shown is a separate component of the mounting and damping system 14*a*, it is understood that the damping member 18 can be integrally molded on the side 20 of the substantially planar portion 24 or on the retainer 27, and the damping member 19 can be integrally molded on the side 22 of the substantially planar portion 24 or in the cavity 16 formed in the housing 12.

As illustrated, the substantially planar portion 24 of the mounting lug 25 and the damping members 18, 19 include respective apertures 28, 30, 32 formed therein. Each of the apertures 28 is aligned with one of the apertures 30 and one of the apertures 32 to receive a bushing 34 of the mounting and damping system 14 therethrough. The bushings 34 shown have a generally cylindrical shape and an internal through opening 35, although it is understood that the bushings 34 can have any shape and size as desired. It is further understood that the bushings 34 can be formed from any suitable material such as a metal material and a plastic material, for example.

A diameter of the apertures 28 is significantly larger than an outer diameter of the bushings 34 to militate against direct contact between the mounting lug 25 and the bushings 34 and further isolate the compressor 10 from the engine or bracket that the mounting lug 25 is affixed to. A diameter of the apertures 30 and a diameter of the apertures 32 are slightly larger than the diameter of the bushings 34 to permit an ease of assembly of the mounting and damping system 14*a*. Accordingly, the damping members 18, 19 may directly contact the bushings 34 if desired. A thickness of the damping members 18, 19, and therefore, a compression of the damping members 18, 19 in the assembled state of the compressor 10, are based upon a length of the bushings 34 and a thickness of the substantially planar portion 24 of the mounting lug 25. In a non-limiting example, the damping members 18, 19 in the assembled state of the compressor 10 are compressed in a range of about 5% to about 15% static compression. It is understood, however, that the damping members 18, 19 can be compressed by any suitable amount to minimize noise and vibration transmitted to and from the compressor 10.

The opening 35 of each of the bushings 34 is aligned with one of the apertures 29 formed in the retainer 27 and one of a plurality of apertures 42 formed in the cavity 16 of the housing 12 to receive a fastener 44 therein. A shear load and an axial load of the fasteners 44 are supported by the bushings 34. Threads 46 formed on an outer surface of the fasteners 44 engage threads 48 formed on an inner surface of the apertures 42 to secure the mounting and damping system 14*a* to the housing 12 of the compressor 10. Although the mounting and damping system 14*a* shown is coupled to the housing 12 by a threaded connection, it is understood that the mounting and damping system 14*a* can be coupled to the housing 12 by any suitable means as desired. An outer diameter of the fasteners 44 is slightly smaller than a diameter of the through opening 35 formed in the bushings 34 to militate against movement of the bushings 34 during an assembly of the mounting and damping system 14*a* and a coupling thereof to the housing 12 of the compressor 10. Each of the apertures 42 may further include a counter bore (not shown) to receive and retain the bushings 34 in a fixed position during the assembly of the mounting and damping system 14*a* and a coupling thereof to the housing 12 of the compressor 10.

As illustrated in FIG. 3, the housing 12 may further include a plurality of blind apertures 50 formed in the cavity 16. Each of the apertures 50 is aligned with one of a plurality of apertures 52 formed in the damping member 19 and one of a plurality of apertures (not shown) formed in the mounting lug 25 to removeably receive an alignment pin (not shown) therein. The alignment pins facilitate a proper positioning of the damping member 19 and the mounting lug 25 relative the housing 12 during the assembly of the mounting and damping system 14*a* and a coupling thereof to the housing 12 of the compressor 10.

To assemble the mounting and damping system 14*a*, the damping member 19 is positioned in the cavity 16 in a desired position. When the damping member 19 is in the desired position, the apertures 32 formed therein substantially align with the apertures 42 formed in the cavity 16 of the housing 12. Thereafter, the bushings 34 are disposed in the apertures 32 formed in the damping member 19. The mounting lug 25 is then positioned on the damping member 19. When the mounting lug 25 is in a desired position, the bushings 34 extend through the apertures 28. The damping member 18 is then disposed on the substantially planar portion 24 of the mounting lug 25 in a desired position having the bushings 34 extending through the apertures 30 formed therein. Thereafter, the retainer 27 is disposed on the damping member 18 in a desired position. Each of the fasteners 44 is then disposed through the aperture 29 of the retainer 27 and the opening 35 of the bushing 34 into the aperture 42 formed in the cavity 16 of the housing 12. Thereafter, the fasteners 44 are rotated in a first direction such that the threads 46 of the fasteners 44 engage the threads 48 of the apertures 42 to form a threaded connection. Once the mounting and damping system 14*a* is assembled and securely coupled to the housing 12 of the compressor 10, the fastener is received in the aperture 26 of the mounting lug 25 to affix the compressor 10 to the engine or bracket.

Alternatively, the mounting and damping system 14*a* may be provided with at least one of the counter bores formed in the cavity 16 and the alignment pins. Accordingly, to assemble the mounting and damping system 14*a* provided with both the counter bores and the alignment pins, the bushings 34 are received in the counter bores of the apertures 42 and the alignment pins are received in the apertures 50 formed in the cavity 16 of the housing 12. Thereafter, the damping member 19 is positioned in the cavity 16 using the bushings 34 and the alignment pins to guide the damping member 19 into a desired position. When the damping member 19 is in the desired position, the bushings 34 and the alignment pins extend through the respective apertures 32, 52 formed therein. The mounting lug 25 is then positioned on the damping member 19 using the alignment pins as a guide. When the mounting lug 25 is in a desired position, the bushings 34 extend through the apertures 28 and the alignment pins extend through the apertures formed in the mounting lug 25. The damping member 18 is then disposed on the substantially planar portion 24 of the mounting lug 25 in a desired position having the bushings 34 extending through the apertures 30 formed therein. Thereafter, the retainer 27 is disposed on the damping member 18 in a desired position. Each of the fasteners 44 is then disposed through the aperture 29 and the opening 35 into the aperture 42 formed in the cavity 16 of the housing 12. Thereafter, the fasteners 44 are rotated in a first direction such that the threads 46 of the fasteners 44 engage the threads 48 of the apertures 42 to form a threaded connection. Once the mounting and damping system 14*a* is assembled and securely coupled to the housing 12 of the compressor 10, the alignment pins are removed and the fastener is received in the aperture 26 of the mounting lug 25 to affix the compressor 10 to the engine or bracket.

Figure 4:
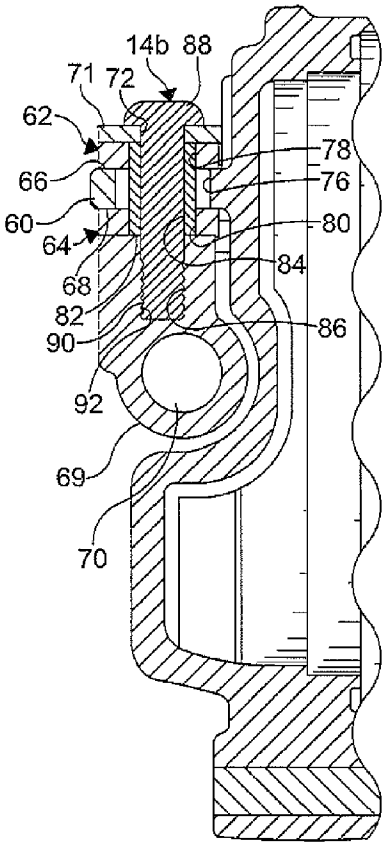
FIG. 4 is an enlarged fragmentary cross-sectional side elevational view of a portion of the compressor illustrated in FIG. 1 taken along line 4-4 of FIG. 1.

As illustrated in FIGS. 1 and 4, each of the mounting and damping systems 14*b* is coupled to a laterally outwardly extending flange 60 formed on the housing 12 of the compressor 10. In the embodiment shown, the mounting and damping system 14*b* includes a pair of damping members 62, 64 disposed on opposite sides 66, 68 of the flange 60. A mounting lug 69 is disposed adjacent the damping member 64 opposite the flange 60 to isolate the mounting lug 69 from the housing 12 of the compressor 10. Accordingly, the compressor 10 is also isolated from an engine or bracket that the mounting lug 69 is affixed to. As illustrated, the mounting lug 69 includes an elongate aperture 70 formed therein. The aperture 70 receives a fastener (not shown) therein for affixing the mounting lug 69 to the engine or bracket.

Each of the damping members 62, 64 shown can be formed from any suitable material to minimize noise and vibration transmitted to and from the compressor 10 such as a resilient elastomer material (e.g. rubber) or a resilient polymer material (e.g. plastic) having a hardness in a range of about 10 Shore A durometer to about 100 Shore A durometer, for example. It is understood, however, that each of the damping members 62, 64 of each of the mounting and damping systems 14*b* can be formed from a material (e.g. elastomer, polymer) having different chemical and physical properties (e.g. hardness) to optimize and tune an assembled state of the compressor 10. It is further understood that the damping members 62, 64 can be formed by any process as desired such as a molding process or a stamping process, for example.

The mounting and damping system 14*b* may further include a retainer 71. The retainer 71 is employed to hold the damping member 62 in position and militate against damage thereto. As shown, the retainer 71 includes a plurality of apertures 72 formed therein. It is understood that the retainer 71 can be formed from any material as desired such as a metal material, for example. Although each of the damping members 62, 64 shown is a separate component of the mounting and damping system 14*b*, it is understood that the damping member 62 can be integrally molded on the side 66 of the flange 60 or on the retainer 71, and the damping member 64 can be integrally molded on the side 68 of the flange 60 or on the mounting lug 69.

As illustrated, the flange 60 and the damping members 62, 64 include respective apertures 76, 78, 80 formed therein. Each of the apertures 76 is aligned with one of the apertures 78 and one of the apertures 80 to receive a bushing 82 of the mounting and damping system 14*b* therethrough. The bushings 82 shown have a generally cylindrical shape and an internal through opening 84, although it is understood that the bushings 82 can have any shape and size as desired. It is further understood that the bushings 82 can be formed from any suitable material such as a metal material and a plastic material, for example.

A diameter of the apertures 76 is significantly larger than an outer diameter of the bushings 82 to militate against direct contact between the flange 60 and the bushings 82 and further isolate the compressor 10 from the engine or bracket that the mounting lug 69 is affixed to. A diameter of the apertures 78 and a diameter of the apertures 80 are slightly larger than the diameter of the bushings 82 to permit an ease of assembly of the mounting and damping system 14*b*. Accordingly, the damping members 62, 64 may directly contact the bushings 82 if desired. A thickness of the damping members 62, 64, and therefore, a compression of the damping members 62, 64 in the assembled state of the compressor 10, are based upon a length of the bushings 82 and a thickness of the flange 60. In a non-limiting example, the damping members 62, 64 in the assembled state of the compressor 10 are compressed in a range of about 5% to about 15% static compression. It is understood, however, that the damping members 62, 64 can be compressed by any suitable amount to minimize noise and vibration transmitted to and from the compressor 10.

The opening 84 of each of the bushings 82 is aligned with one of the apertures 72 formed in the retainer 71 and one of a plurality of apertures 86 formed in the mounting lug 69 to receive a fastener 88 therein. A shear load and an axial load of the fasteners 88 are supported by the bushings 82. Threads 90 formed on an outer surface of the fasteners 88 engage threads 92 formed on an inner surface of the apertures 86 to secure the mounting and damping system 14*b* to the housing 12 of the compressor 10. Although the mounting and damping system 14*b* shown is coupled to the housing 12 by a threaded connection, it is understood that the mounting and damping system 14*b* can be coupled to the housing 12 by any suitable means as desired. An outer diameter of the fasteners 88 is slightly smaller than a diameter of the through opening 84 formed in the bushings 82 to militate against movement of the bushings 82 during an assembly of the mounting and damping system 14*b* and a coupling thereof to the housing 12 of the compressor 10. Each of the apertures 86 may further include a counter bore (not shown) to receive and retain the bushings 82 in a fixed position and align the mounting lug 69 during the assembly of the mounting and damping system 14*b* and a coupling thereof to the housing 12 of the compressor 10.

To assemble the mounting and damping system 14*b*, the damping members 62, 64 are positioned on opposite sides 66, 68 of the flange 60. The apertures 76, 78, 80 formed in the flange 60 and the damping members 62, 64, respectively, are aligned and the bushing 82 is inserted therein, The mounting lug 69 is then positioned on the damping member 64. When the mounting lug 69 is in a desired position, the openings 84 of the bushings 82 align with the apertures 86 formed therein. Thereafter, the retainer 71 is disposed on the damping member 62 in a desired position having the apertures 72 aligned with the openings 84 of the bushings 82. The fasteners 88 are then received through the apertures 72 and the openings 84 into the apertures 86 formed in the mounting lug 69. Thereafter, the fasteners 88 are rotated in a first direction such that the threads 90 of the fasteners 88 engage the threads 92 of the apertures 86 to form a threaded connection. Once the mounting and damping system 14*b* is assembled and securely coupled to the housing 12 of the compressor 10, the fastener is received in the aperture 70 of the mounting lug 69 to affix the compressor 10 to the engine or bracket.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A mounting and damping system for a compressor comprising:

a mounting lug removably coupled to a housing of the compressor;

a first damping member disposed between the mounting lug and a first portion of the housing, the first damping member having a first aperture formed therein;

a second damping member having a second aperture formed therein; and a bushing having a through opening formed therein, wherein a first end of the bushing is received in the first aperture formed in the first damping member, a second end of the bushing is received in the second aperture formed in the second damping member, and an outer surface of the bushing intermediate the first damping member and the second damping member is surrounded by a hollow opening, the hollow opening spacing the outer surface of the bushing from an inner surface of one of the mounting lug and the first portion of the housing to militate against contact therebetween.

2. The mounting and damping system according to claim 1, wherein the mounting lug is at least partially received in a cavity formed in the housing.

3. The mounting and damping system according to claim 1, wherein the second damping member is disposed between the mounting lug and a retainer.

4. The mounting and damping system according to claim 1, wherein the second damping member is disposed between the first portion of the housing and a retainer.

5. The mounting and damping system according to claim 1, wherein an outer diameter of the bushing is smaller than a diameter of a third aperture, wherein the third aperture is formed in one of the mounting lug and the first portion of the housing to militate against contact between the outer surface of the bushing and the inner surface of one of the mounting lug and the first portion of the housing.

6. The mounting and damping system according to claim 1, wherein the first damping member is formed from a material having a hardness in a range of about 10 Shore A durometer to about 100 Shore A durometer.

7. A mounting and damping system for a compressor comprising:

a mounting lug removably coupled to a housing of the compressor, wherein the mounting lug is at least partially received in a cavity formed in the housing and includes an aperture formed therein;

a first damping member disposed between the mounting lug and a first portion of the housing, the first damping member including an aperture formed therein;

a second damping member disposed between the mounting lug and a retainer, the second damping member including an aperture formed therein, wherein the aperture of the mounting lug, the aperture of the first damping member, and the aperture of the second damping member are substantially aligned; and a bushing having a through opening formed therein, wherein the bushing is disposed in the apertures formed in the mounting lug, the first damping member, and the second damping member; wherein an outer diameter of the bushing is smaller than a diameter of the aperture formed in the mounting lug to form a hollow opening between an outer surface of the bushing and an inner surface of the mounting lug, wherein the hollow opening militates against contact between the outer surface of the bushing and the inner surface of the mounting lug.

8. The mounting and damping system according to claim 7, wherein the first damping member is integrally formed with one of the mounting lug and the first portion of the housing.

9. The mounting and damping system according to claim 7, wherein the second damping member is integrally formed with one of the mounting lug and the retainer.

10. The mounting and damping system according to claim 7, wherein the through opening of the bushing receives a fastener therein.

11. The mounting and damping system according to claim 7, wherein at least one of the damping members is formed from a material having a hardness in a range of about 10 Shore A durometer to about 100 Shore A durometer.

12. A mounting and damping system for a compressor comprising:

a first mounting lug removably coupled to a flange extending outwardly from a housing of the compressor, wherein the first mounting lug includes an aperture formed therein and the flange includes an aperture formed therein;

a first damping member disposed between the first mounting lug and the flange of the housing, the first damping member including an aperture formed therein;

a second damping member disposed between the flange and a retainer, the second damping member including an aperture formed therein, wherein the aperture of the flange, the aperture of the first damping member, and the aperture of the second damping member are substantially aligned; and a first bushing having a through opening formed therein, wherein the first bushing is disposed in the apertures formed in the flange, the first damping member, and the second damping member; wherein an outer diameter of the first bushing is smaller than a diameter of the aperture formed in the flange to form a hollow opening between an outer surface of the first bushing and an inner surface of the flange, wherein the hollow opening militates against contact between the outer surface of the first bushing and the inner surface of the flange.

13. The mounting and damping system according to claim 12, wherein the first damping member is integrally formed with one of the first mounting lug and the flange.

14. The mounting and damping system according to claim 12, wherein the second damping member is integrally formed with one of the flange and the retainer.

15. The mounting and damping system according to claim 12, wherein the through opening of the first bushing receives a fastener therein.

16. The mounting and damping system according to claim 12, further comprising:

a second mounting lug removably coupled to the housing of the compressor, wherein the second mounting lug includes an aperture formed therein;

a third damping member disposed between the second mounting lug and a first portion of the housing, the third damping member including an aperture formed therein;

a fourth damping member disposed between the second mounting lug and a second retainer, the fourth damping member including an aperture formed therein, wherein the aperture of the second mounting lug, the aperture of the third damping member, and the aperture of the fourth damping member are substantially aligned; and a second bushing disposed in the apertures of the second mounting lug and the third and fourth damping members, wherein an outer diameter of the second bushing is smaller than a diameter of the aperture formed in the second mounting lug to militate against contact therebetween.

17. The mounting and damping system according to claim 16, wherein the second mounting lug is at least partially received in a cavity foamed in the housing.

18. The mounting and damping system according to claim 12, wherein at least one of the first and second damping members is formed from a material having a hardness in a range of about 10 Shore A durometer to about 100 Shore A durometer.

* * * * *